US009548555B2

(12) United States Patent
Guo et al.

(10) Patent No.: US 9,548,555 B2
(45) Date of Patent: Jan. 17, 2017

(54) CABLE CONNECTOR ASSEMBLY EASY TO ASSEMBLE

(71) Applicant: FOXCONN INTERCONNECT TECHNOLOGY LIMITED, Grand Cayman (KY)

(72) Inventors: Fei Guo, Kunshan (CN); Xu-Xiang Qi, Kunshan (CN); Cai-Yu Zhuang, Kunshan (CN); Yang-Tsun Hsu, New Taipei (TW); Chao-Ling Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/081,963

(22) Filed: Mar. 28, 2016

(65) Prior Publication Data

US 2016/0285190 A1 Sep. 29, 2016

(30) Foreign Application Priority Data

Mar. 27, 2015 (CN) ..... 2015 2 0177739 U

(51) Int. Cl.

| | |
|---|---|
| ***H01R 4/24*** | (2006.01) |
| ***H01R 13/422*** | (2006.01) |
| ***H01R 24/58*** | (2011.01) |
| *H01R 107/00* | (2006.01) |

(52) U.S. Cl.

CPC ..... *H01R 13/422* (2013.01); *H01R 24/58* (2013.01); *H01R 4/2433* (2013.01); *H01R 4/2445* (2013.01); *H01R 2107/00* (2013.01)

(58) Field of Classification Search

USPC ..... 439/417, 409

See application file for complete search history.

(56) References Cited

U.S. PATENT DOCUMENTS 4,915,645 A * 4/1990 Konnemann ..... H01R 13/4361 439/417

4,975,078 A * 12/1990 Stroede ..... H01R 24/62 439/405

(Continued)

FOREIGN PATENT DOCUMENTS

CN 202333250 U 7/2012

*Primary Examiner* — Tho D Ta

(74) *Attorney, Agent, or Firm* — Wei Te Chung; Ming Chieh Chang

(57) ABSTRACT

A cable connector assembly including: a cable including a number of core wires, each core wire including an insulative layer and an inner conductor; and an electrical connector connected with an end of the cable, the electrical connector including an insulative housing, a number of contacts retained in the insulative housing, a shell member enclosing the insulative housing, a cover member assembled on a rear end of the insulative housing for fixing the core wires, and a carrying member connected between the cover member and the insulative housing, each of the contacts including a mounting portion rearwardly exposed to the insulative housing, wherein each of the mounting portion defines a spines portion, the cover member defines a number of through holes receiving the core wires, and the insulative layer of the core wire is punctured by the spines portion when the cover member is mounted on the carrying member.

16 Claims, 7 Drawing Sheets

(56) References Cited

U.S. PATENT DOCUMENTS

| | | | | | |
|---|---|---|---|---|---|
| 5,605,469 | A * | 2/1997 | Wellinsky | H01R 4/2433 | 439/417 |
| 6,077,122 | A * | 6/2000 | Elkhatib | H01R 13/5804 | 439/417 |
| 6,966,793 | B2 * | 11/2005 | Brekosky | H01R 4/2404 | 439/393 |
| 7,819,690 | B2 | 10/2010 | Faulkner et al. | | |
| 8,052,461 | B2 | 11/2011 | Wang | | |
| 2009/0017684 | A1 * | 1/2009 | Lin | H01R 4/2433 | 439/607.41 |

* cited by examiner

CABLE CONNECTOR ASSEMBLY EASY TO ASSEMBLE

BACKGROUND OF THE INVENTION

1. Field of the Invention

The present invention relates generally to a cable connector assembly, and more particularly to an audio connector easy to assemble.

2. Description of Related Arts

U.S. Pat. No. 7,819,690, published on Aug. 21, 2008, discloses a monitoring device including a plurality of electrical contacts or connectors in cooperation with a belt including a plurality of tension members. The connector has a portion that penetrates into the belt for making electrically conductive contact with the tension member. The connector has a base that is generally planar and aligned with a longitudinal axis of the tension member. Two projections extend away from the base.

U.S. Pat. No. 8,052,461, published on Nov. 8, 2011, and Patent No. 202333250, published on Jul. 11, 2012, each discloses a connecting scheme for a cable and a connector, which has a spiked metal terminal consisting of two spinous portions. The arrangement of the two spinous portions is along a direction perpendicular to the axial direction of the cable wire. Such arrangement ensures reliable connection but takes up more horizontal space. Therefore, a soldering method is usually used to connect the metal terminal, which is preferred over a crimping method that needs a more cumbersome manufacturing process and costs more.

A cable connector assembly of a different structure is desired.

SUMMARY OF THE INVENTION

Accordingly, an object of the present invention is to provide an improved cable connector assembly.

To achieve the above object, a cable connector assembly comprises: a cable including a number of core wires, each of the core wires including an insulative layer and an inner conductor; and an electrical connector connected with an end of the cable, the electrical connector including an insulative housing, a number of contacts retained in the insulative housing, a shell member enclosing the insulative housing, a cover member assembled on a rear end of the insulative housing for fixing the core wires, and a carrying member connected between the cover member and the insulative housing, each of the contacts including a mounting portion rearwardly exposed to the insulative housing, wherein the mounting portion of the contact defines a spines portion upwardly extending, the cover member defines a number of through holes receiving the core wires, and the insulative layer of the core wire is punctured by the spines portion when the cover member is mounted on the carrying member to connect the inner conductor of the core wire to the contact.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
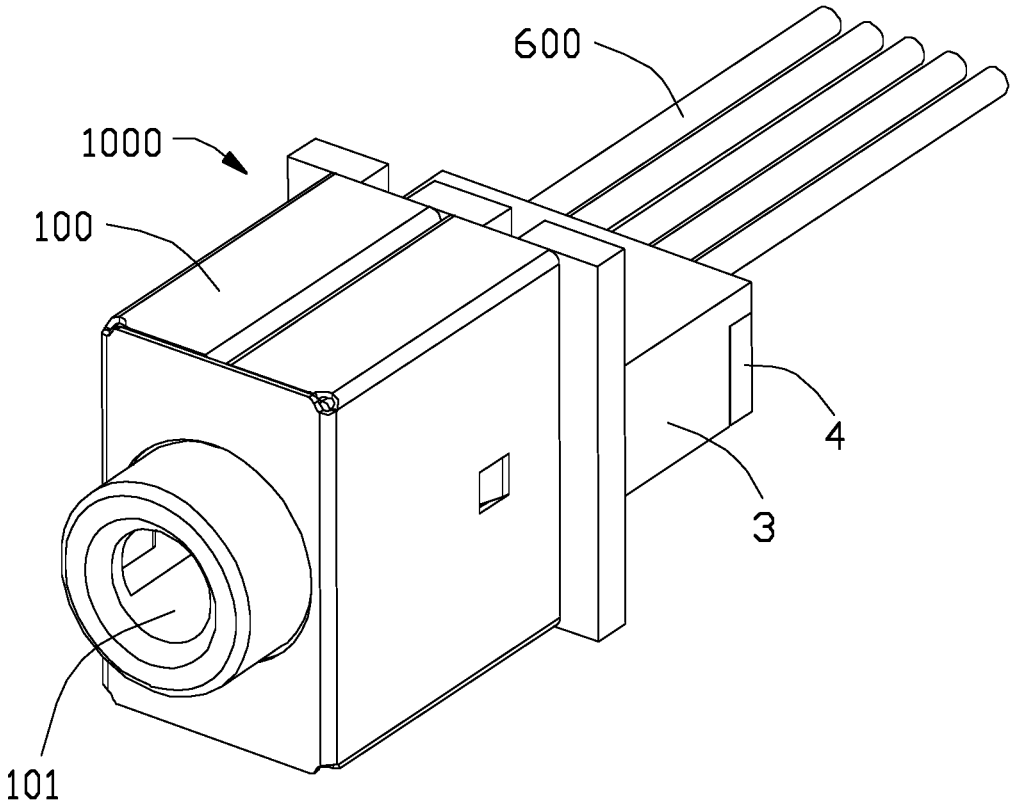
FIG. 1 is a perspective, assembled view of a cable connector assembly constructed in accordance with the present invention.
Figure 2:
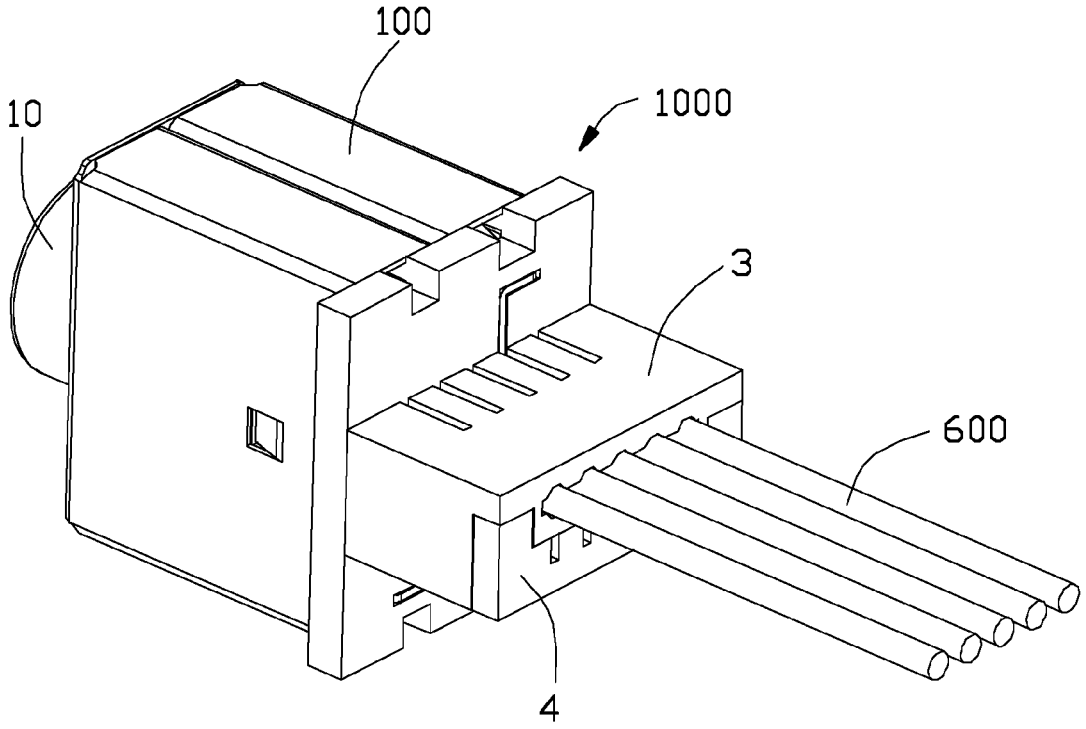
FIG. 2 is similar to FIG. 1, but taken from a different view.
Figure 3:
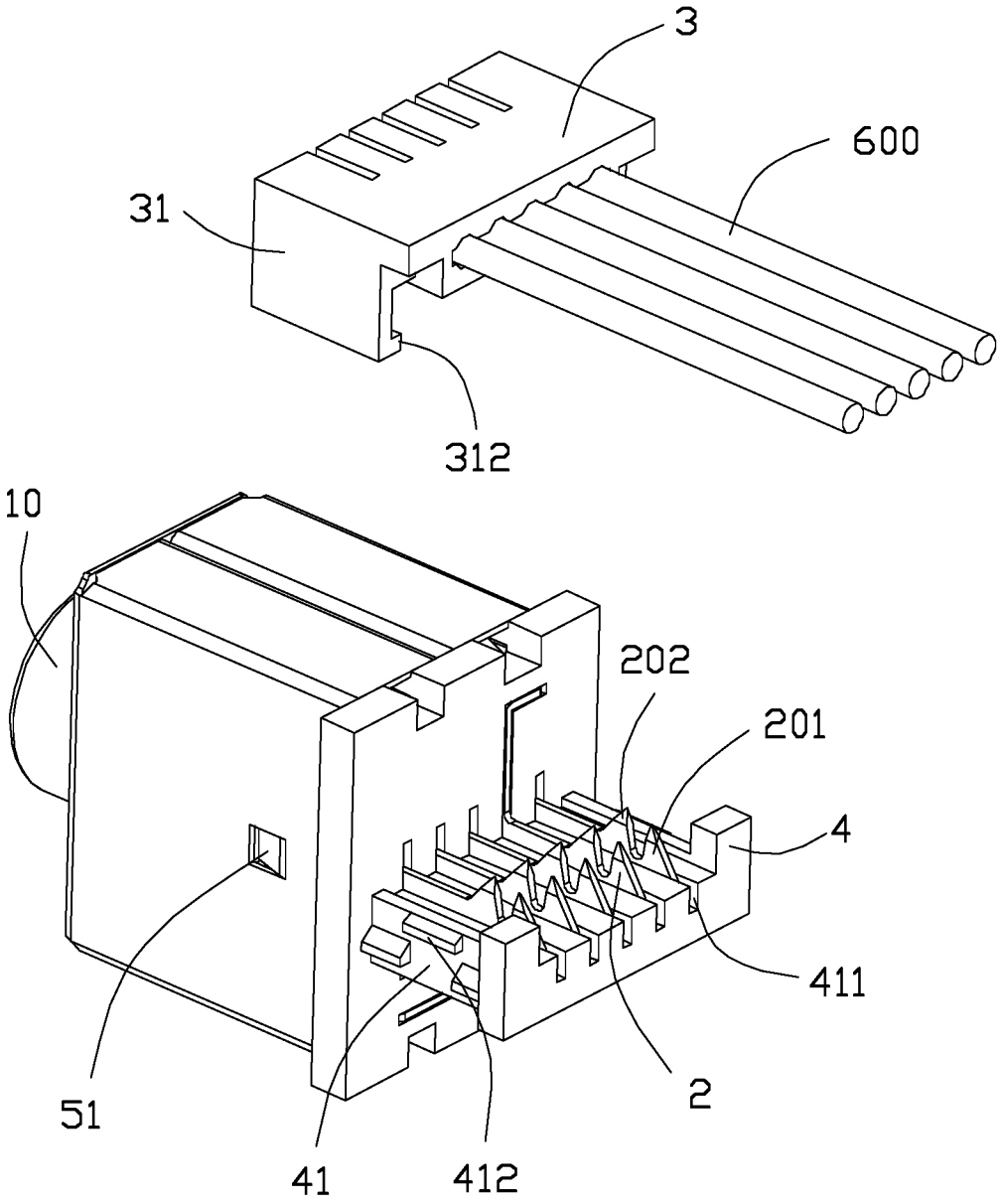
FIG. 3 is a perspective, partly exposed view of the cable connector assembly show in FIG. 1.
Figure 4:
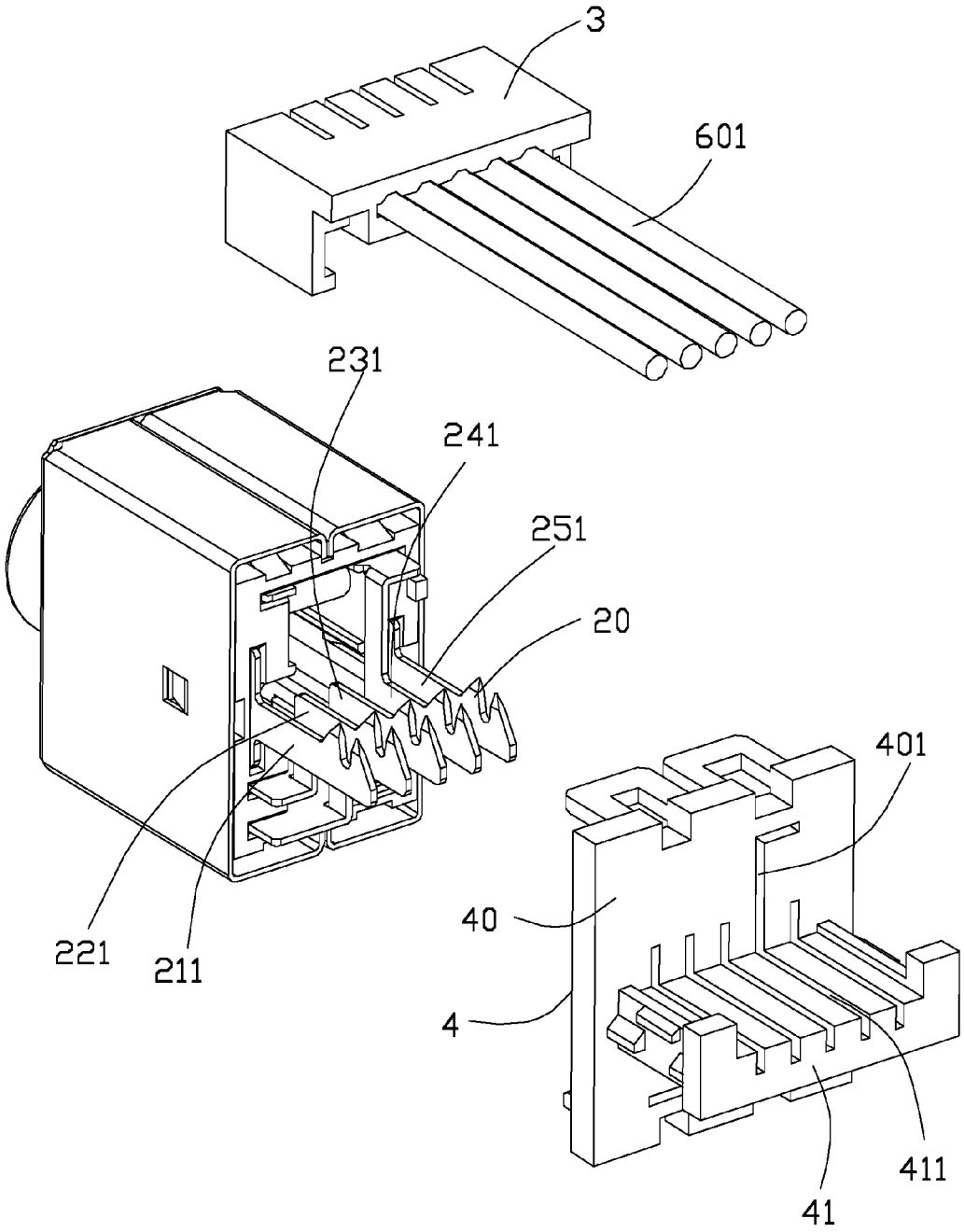
FIG. 4 is a further exploded perspective view of the cable connector of FIG. 3.
Figure 5:
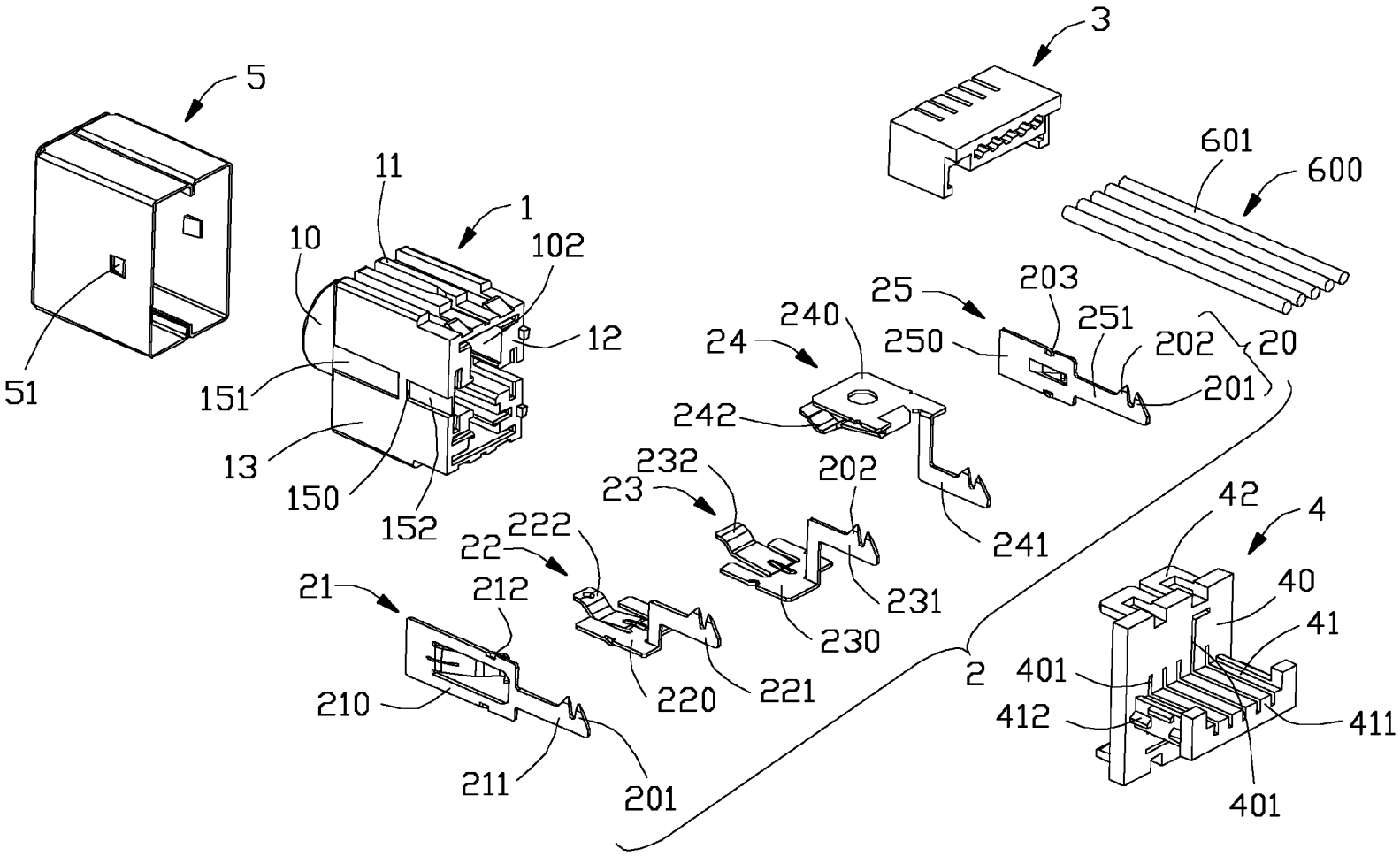
FIG. 5 is perspective, further exposed view of the cable connector assembly show in FIG. 4.
Figure 6:
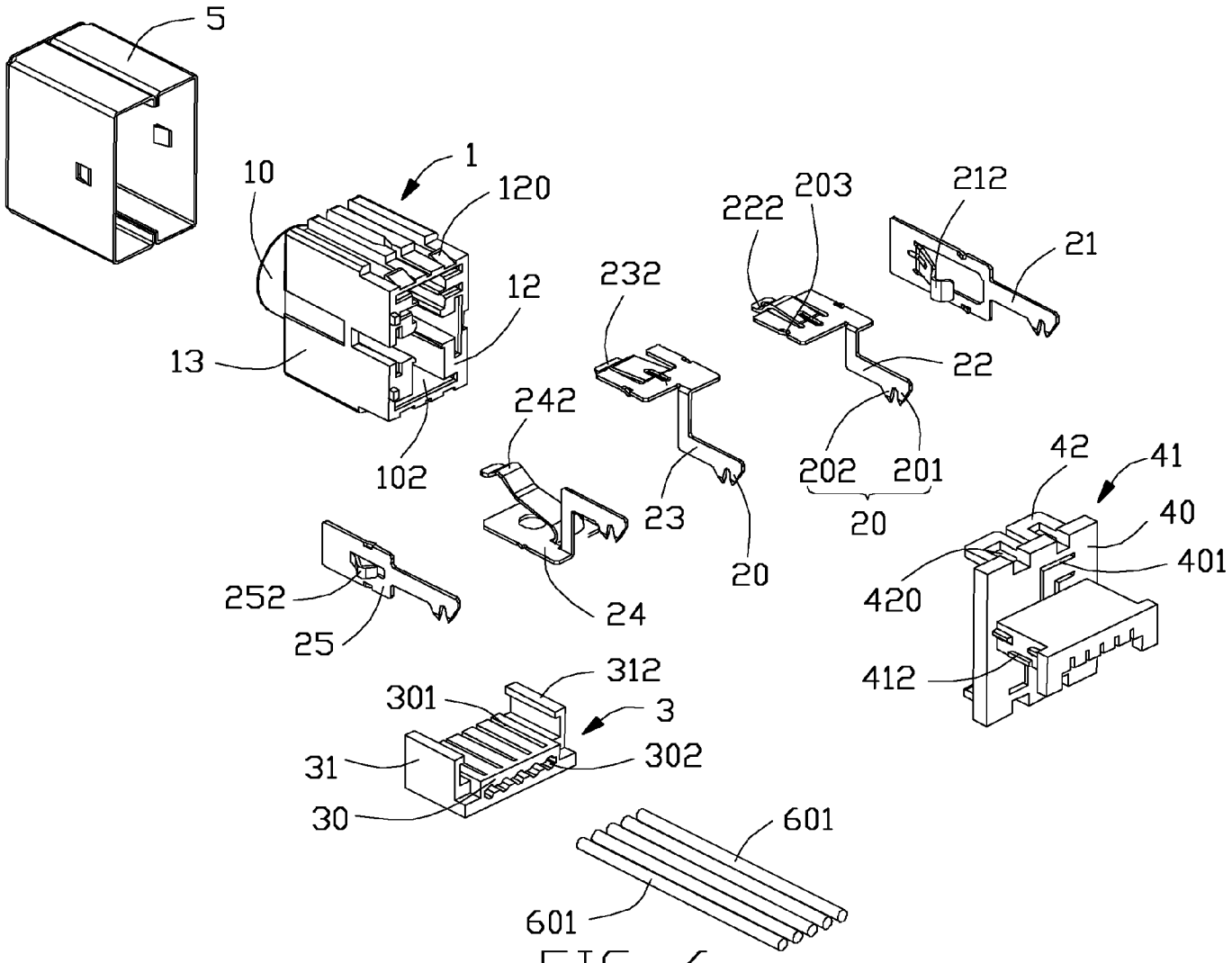
FIG. 6 is similar to FIG. 5, but taken from a different view.
Figure 7:
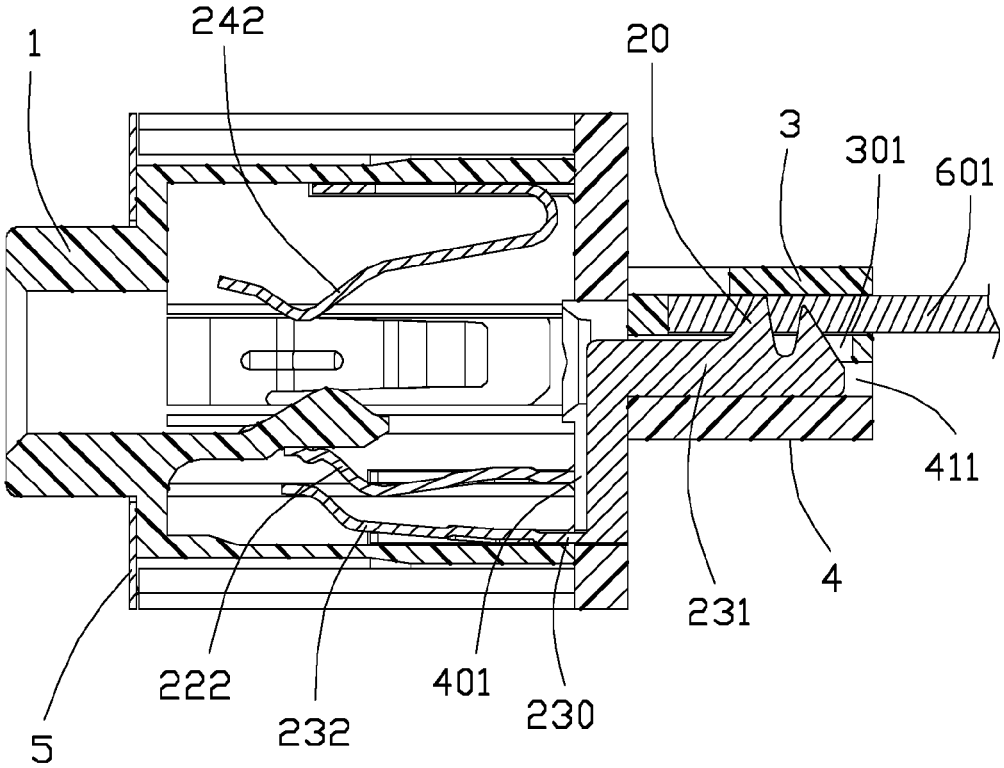
FIG. 7 is a cross-sectional view of the cable connector assembly of FIG. 1.

Referring to FIGS. 1-7, a cable connector assembly 1000 of the present invention includes a cable 600 comprising a plurality of core wires 601, and an electrical connector 100 assembled on an end of the cable 600. Each of the core wires 601 includes an insulative layer (not shown) and an inner conductor (not shown). The electrical connector 100 includes an insulative housing 1, a plurality of the contacts 2 retained in the insulative housing 1, a shell member 5 enclosing the insulative housing 1, a cover 3 member assembled on a rear end of the insulative housing 1 for fixing an end of the cable 600 and a carrying member 4 connected between the insulative housing 1 and cover member 3. Preferably, the shell member 5 is made of a sheet metal by stamping, the carrying member 4 and the cover member 3 is molded by insulative material. The electrical connector 100 is an audio connector. The insulative housing 1 defines a cylindrical mating portion 10 defining a mating room 101 extending along a front-to-back direction, which having a forward opening to receiving an inserted audio plug (not shown). The insulative housing 1 defines a receiving room 102 which having a rearward opening. The receiving room 102 is used to receive the contacts 2 forwardly inserted into the insulative housing 1.

In the present embodiment, the contacts 2 includes a first contact 21, a second contact 22, a third contact 23, the fourth contact 24, and a fifth contact 25. Obvious, according to user needs, the contacts 2 can includes fewer or more contacts, and the member of the contacts is not limited to this embodiment. The first contact 21 includes a first mounting portion 211 rearwardly exposed to the insulative housing 1, a first fixing portion 210 retained within the corresponding passageway (not labeled) in the insulative housing 1 and a resilient first contacting portion 212 horizontally extending from the first fixing portion 210. The second contact 22 includes second mounting portion 221 rearwardly exposed to the insulative housing 1, a second fixing portion 220 retained in the corresponding passageway (not labeled) in the insulative housing 1 and a resilient second contacting portion 222 forwardly extending from the second fixing portion 220. The third contact 23 includes a third mounting portion 231 rearwardly exposed to the insulative housing 1, a third fixing portion 230 retained in the insulative housing 1 and a resilient third contacting portion 232 forwardly extending from the third fixing portion 230. The fourth contact 24 includes a fourth mounting portion 241 rearwardly exposed to the insulative housing 1, a fourth fixing portion 240 fixed on the insulative housing 1 and a resilient fourth contacting portion 242 downwardly extending from the fourth fixing portion 240. The fifth contact 25 includes a fifth mounting portion 251 rearwardly exposed to the insulative housing 1, a fifth fixing portion 250 fixed on the insulative housing 1 and a resilient fifth contacting portion 252 horizontally extending from the fourth fixing portion 250. Wherein, the first mounting portion 211, the second mounting portion 221, the third mounting portion 231, the fourth mounting portion 241 and the fifth mounting portion 251 transversely aligns to form a row along a lateral direction which perpendicular to a front-to-rear direction, to easy for the mounting of the core wires 601. Each of the first fixing portion 210, the second fixing portion 220, the third fixing portion 230, the fourth fixing portion 240 and the fifth fixing portion 250 defines a hangnail portion 203. The hangnail portion 203 makes the contacts 2 be fixed on the insulative housing 1 securely.

The cover member 3 includes a top wall 30 generally horizontally disposed, a pair of connecting arm 31 downwardly extending from the both sides of the top wall 30. The top wall 30 defines a plurality of rearward receiving holes 302 for receiving the core wires 601, and a plurality of isolating slots 301 downwardly and aligning the center line of each receiving holes 302 extended. The isolating slots 301 are used to isolate the contacts 2. The end of each connecting arm 31 defines a hook 312 for fixing the cover member 3 on the carrying member 4. The carrying member 4 includes a base portion 40, a connecting portion 42 forwardly and horizontally extending from the base portion 40 and fixing on the insulative housing 1, and a plate portion 41 rearwardly and horizontally extending from the base portion 40. The base portion 40 is vertically disposed and bears against a rear end of the insulative housing 1 for covering the receiving room 102 after the contacts 2 being inserted. The base portion 40 defines a plurality of through holes/grooves 411 for receiving the first, second, third, fourth, and fifth mounting portion 211, 221, 231, 241, and 251. The plate portion 41 defines a pair of fixing block 412 on both sides thereof for fixing with the hook 312 of the cover member 3. Each of the first, second, third, fourth, fifth mounting portion 211, 221, 231, 241, 251 defines a spines portion 20 upwardly exposed to the through holes 411 from the carrying member 4. Preferably, in order to save horizontal space of the electrical connector 100 and ensure that the core wire 601 and the terminal 2 of full contact, the spines portion 20 includes a first protruding portion 201 and a second protruding portion 202 aligned in the longitudinal direction. When the cover member 3 with the mounted core wires 601 therein is fixed on the plate portion 41 of the carrying member 4 along a top-to-bottom direction, the insulative layer of the core wires 601 are punctured by the first protruding portion 201 and the second protruding portion 202 of the contacts 2, the inner conductor of the core wires 601 electrically connected with the spines portion 20 between the cover member 3 and the plate portion 41.

In the present embodiment, the first, second, third, fourth and fifth contacting portion of the contacts 2 are distributed in the peripheral of the receiving room 101 of the mating portion 10, to get electrically connection with the cylindrical audio plug. The connecting portion 42 upwardly extending from the base portion 40 defines a mounting hole 420. The top side (not shown) of the insulative housing 1 defines a protruding table 120 engaged with the mounting hole 420, thus the connecting portion 42 is fixed between the shell member 5 and the insulative housing 1. The insulative housing 1 defines a front wall 11, rear wall 12 and two side walls 13 connected between the front wall 11 and the rear wall 12. The shell member 5 defines a pair of resilient sheet 51 inwardly extending from local depression portion thereof. Each of the side walls 13 defines a guide groove 151 for guiding the corresponding resilient sheet 51, a fixing groove 152 for receiving the resilient sheet 51 and a stopping portion 150 positioned between the guide groove 151 and fixing groove 152 for bear against the resilient sheet 51, such making the insulative housing 1 fixedly being mounted in the shell member 5.

In summary, the cable connector assembly 1000 according to the present invention has a simple structure and reliable performance and is easy to assemble. Another feature of the invention is to provide al the contacts 21, 22, 23, 24, 25 with the contacting portions 212, 222, 232, 242, 252 surrounding, optionally circumferentially in an even manner, the mating room 101 with the IDC type (Insulation Displacement Contact) mounting portions 211, 221, 231, 241, 251, at the same level in the vertical direction, each extending in a vertical plane defined by the front-to-back direction and the vertical direction, and aligned with the corresponding wire 601 so as to have the corresponding spine portion 20 pierce into the corresponding wire 601 under a fine pitch arrangement in the transverse direction, or alternately such IDC type mounting portions 211, 221, 231, 241, 251 each extending in a vertical plane, along the transverse direction, so as to have the fork type spine portion 20 pierce into and straddle the corresponding inner conductor of each wire in a staggered manner along the front-to-back direction. In this embodiment, each of the contacting portions 212, 222, 232, 242, 254 is stamped/standing from the corresponding fixing portion 210, 22, 230, 240, 250 even though such fixing portions 210, 220, 230, 240, 250 are located in different vertical and/or horizontal planes while the mounting portions 211, 221, 231, 241, 251 are densely arranged along the transverse direction and reliably received within the corresponding slots/grooves/slits provided within the carrying member 4 and the cover member 3. As mentioned before, in this embodiment each of the mounting portions lies in the vertical plane defined by the front-to-back direction and the vertical direction; alternately, each of the mounting portions may lie in the vertical plane defined by the transverse direction and the vertical direction. As shown in the cross-sectional view of FIG. 1, in the instant invention the mounting portion 211, 221, 231, 241, 251 are protectively retained within the corresponding groove 411 of the carrying member 4 while the corresponding spine portion 20 is retained within the corresponding slot 301 of the cover member 3 so that the retention between spine portion 20 and the corresponding wire 601 is pretty reliable compared with the prior arts. As another feature of the invention, some slots or slits 401 in the base portion 40 for respectively receiving the rear sections of the fixing portions of the corresponding contacts and/or the front sections of the mounting portions of the corresponding contacts, are different from one another due to differently positioned fixing portions with regard to the mounting portions. Notably, in this embodiment the mounting portions 221, 231, 241 are of an L-shaped configuration while the mounting portions 211, 251 is of a straight line configuration.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector assembly comprising:

a cable including a plurality of core wires, each of the core wires including an insulative layer and an inner conductor; and an electrical connector connected with an end of the cable, the electrical connector including an insulative housing, a plurality of contacts retained in the insulative housing, a shell member enclosing the insulative housing, a cover member assembled on a rear end of the insulative housing for fixing the core wires, and a carrying member connected between the cover member and the insulative housing, each of the contacts including a mounting portion rearwardly exposed to the insulative housing; wherein the mounting portion of the contact defines a spines portion upwardly extending, the cover member defines a plurality of through holes receiving the core wires, and the insulative layer of the core wire is punctured by the spines portion when the cover member is mounted on the carrying member to connect the inner conductor of the core wire to the contact;

wherein the carrying member includes a base portion, a connecting portion forwardly and horizontally extending from the base portion and fixed on the insulative housing, and a plate portion rearwardly and horizontally extending from the base portion; and the cover member defines a connecting arm downwardly extending to fix to the plate portion;

wherein the contact has a fixing portion fixed in the insulative housing and a resilient contacting portion extending from the fixing portion, and the insulative housing defines a rearward receiving room receiving the contacting portion;

wherein the base portion is vertically disposed and bears against a rear end of the insulative housing to cover the receiving room, and the connecting portion is fixed between the insulative housing and the cover member.

2. The cable connector assembly as claimed in claim 1, wherein the spines portion includes a first protruding portion and a second protruding portion aligned in a longitudinal direction.

3. The cable connector assembly as claimed in claim 1, wherein the base portion of the carrying member has a plurality of receiving holes for the contacts to pass through.

4. The cable connector assembly as claimed in claim 1, wherein the mounting portions of the contacts are transversely aligned in a row, and the plate portion defines a plurality of through holes receiving the mounting portions of the contacts.

5. The cable connector assembly as claimed in claim 1, wherein the insulative housing defines a cylindrical mating portion, the mating portion defines a mating room having a forward opening, and the contacting portions of the contacts are distributed in a periphery of the mating room.

6. The cable connector assembly as claimed in claim 1, wherein the connecting arm of the cover member defines a hook, and the plate portion of the carrying member defines a fixing block fixed to the hook.

7. A cable connector assembly comprising:

an insulative housing defining a mating room extending along a front-to-back direction;

a plurality of passageways formed in the housing and transversely communicating with the mating room;

a plurality of contacts each having a fixing portion extending in a plane and retained in the corresponding passageway, a contacting portion stamped and extending from the fixing portion into the mating room, and a mounting portion extending rearwardly from the fixing portion in a vertical plane defined by said front-to-back direction and a vertical direction perpendicular to said front-to-back direction, said mounting portions of all said contacts extending in the different vertical planes spaced from one another in a transverse direction perpendicular to both said front-to-back direction and said vertical direction, each of the mounting portions being equipped with a spine portion; a carrying member located behind the housing and including a plate portion with a plurality of grooves to receive the corresponding mounting portions therein, respectively; and a cover member assembled with the carrying member and equipped with a plurality of slots aligned with the corresponding grooves to receive the corresponding spine portions, respectively, and a plurality of holes communicating with the corresponding slots in the vertical direction to receive corresponding wires so as to allow the corresponding spine portions of said contacts to pierce into the corresponding wires, respectively;

wherein said carrying member further includes a base portion in front of the plate portion, and said base portion forms a plurality of slits essentially aligned with the corresponding grooves in the front-to-back direction, respectively, and some of said slits are configured different from one another for compliance with the differently positioned fixing portions, respectively.

8. The cable connector assembly as claimed in claim 7, wherein the planes in which the fixing portions of the contacts are located, are either the vertical plane defined by the front-to-back direction and the vertical direction, or a horizontal plane defined by the transverse direction and the vertical direction.

9. The cable connector assembly as claimed in claim 8, wherein the two fixing portions in the two corresponding vertical planes are located between the two fixing portions in the two corresponding horizontal planes in the vertical direction.

10. The cable connector assembly as claimed in claim 8, wherein there are two fixing portions in the corresponding two vertical planes and three fixing portions in the corresponding horizontal planes.

11. The cable connector assembly as claimed in claim 8, wherein the fixing portion extending in the vertical plane, is coplanar with the corresponding mounting portion while the fixing portion extending in the horizontal plane, is perpendicular to the corresponding mounting portion.

12. The cable connector assembly as claimed in claim 8, wherein the contacting having the fixing portion extending in the horizontal plane, forms the corresponding mounting portion of an L-shaped configuration.

13. A cable connector assembly comprising:

an insulative housing defining a mating room extending along a front-to-back direction;

a plurality of passageways formed in the housing and transversely communicating with the mating room;

a plurality of contacts each having a fixing portion extending in a plane and retained in the corresponding passageway, a contacting portion stamped and extending from the fixing portion into the mating room, and a mounting portion extending rearwardly from the fixing portion, said mounting portions of said contacts being spaced from one another in a transverse direction perpendicular to both said front-to-back direction, each of the mounting portions being equipped with a spine portion which extends in a vertical direction perpendicular to both said front-to-back direction and said transverse direction;

a carrying member located behind the housing and including a horizontally extending plate portion with a plurality of grooves to receive the corresponding mounting portions therein, respectively, and a base portion in front of said plate portion with a plurality of slits essentially aligned with the corresponding grooves in the front-to-back direction, to receive front sections of the corresponding mounting portions therein, respectively; and a cover member assembled with the carrying member and equipped with a plurality of slots aligned with the corresponding grooves to receive the corresponding spine portions, respectively, and a plurality of holes communicating with the corresponding slots in the vertical direction to receive corresponding wires so as to allow the corresponding spine portions of said contacts to pierce into the corresponding wires, respectively.

14. The cable connector assembly as claimed in claim 13, wherein some of said slits further receive rear sections of the fixing portions of the corresponding contacts, respectively.

15. The cable connector assembly as claimed in claim 13, wherein the cover member is assembled to the carrying member in the vertical direction while the carrying member is forwardly assembled to the housing in said front-to-back direction.

16. The cable connector assembly as claimed in claim 13, wherein said base portion extends in a vertical plane defined by the vertical direction and the transverse direction, and some of said slits are configured different from one another.

* * * * *